US008057274B2

(12) United States Patent
Gamble

(10) Patent No.: US 8,057,274 B2
(45) Date of Patent: Nov. 15, 2011

(54) DOLL AND FLOTATION DEVICE-COMBINATION FOR DEMONSTRATING WATER SAFETY

(76) Inventor: Gregory Gamble, Philadelphia, PA (US)

( * ) Notice: Subject to any disclaimer, the term of this patent is extended or adjusted under 35 U.S.C. 154(b) by 1255 days.

(21) Appl. No.: 11/398,408

(22) Filed: Apr. 5, 2006

(65) Prior Publication Data

US 2007/0238376 A1 Oct. 11, 2007

(51) Int. Cl.
*A63H 23/10* (2006.01)
*A63H 23/00* (2006.01)

(52) U.S. Cl. ..... 446/153; 441/106

(58) Field of Classification Search ..... 446/153, 446/155; 472/129; 441/106; 434/254
See application file for complete search history.

(56) References Cited

U.S. PATENT DOCUMENTS 3,364,616 A 1/1968 Speers
3,392,483 A 7/1968 Beatty, Sr.
3,601,922 A 8/1971 Shaffer
3,621,604 A 11/1971 Danielsen
3,693,292 A 9/1972 Di Leva
4,536,165 A * 8/1985 Maar ..... 446/153
4,787,874 A 11/1988 Hardy
4,973,277 A * 11/1990 Khanamirian ..... 441/88
5,588,891 A * 12/1996 Bardot ..... 441/115
5,865,663 A 2/1999 Liao
6,773,330 B1 8/2004 Cohen
6,923,706 B1 8/2005 Arias

* cited by examiner

*Primary Examiner* — Kien Nguyen
(74) *Attorney, Agent, or Firm* — Stephen H. Eland; Dann, Dorfman, Herrell & Skillman

(57) ABSTRACT

A combination of doll and flotation device for demonstrating water safety employs a doll of human-like form sufficiently heavy to sink in water. A removable flotation device which fits the doll, such as a life jacket is designed to be placed on the doll and secured by fasteners such as the Velcro® fixed to opposed edges along the closure gap in the life vest. The life vest, or other flotation device, must be sufficiently buoyant to support the doll as well as it's own weight. The combination has utility in teaching children and adults life saving using familiar devices used in water safety. It allows the student to apply the flotation device to the doll, and remove it as required, and place the doll in the water to float with the flotation device or sink without it.

5 Claims, 3 Drawing Sheets

DOLL AND FLOTATION DEVICE-COMBINATION FOR DEMONSTRATING WATER SAFETY

FIELD OF THE INVENTION

The present invention relates to a doll designed as an aid in teaching swimming pool and general water safety. The concept is relatively straightforward, to provide a doll which will sink to the bottom of a pool, but which in combination with a flotation device will be supported at the water surface. The doll is separable from its flotation device, which may be in the form of a life vest or other type of flotation device, preferably fitted to the doll and held in place on to the doll by some conventional fastener. The flotation device should be easily put on and removed from the doll for demonstration purposes.

The prior art has many flotation toys, including dolls which are constructed to be or become capable of floating. Some of these are hollow, flexible blow-up structures and others are made of light materials which because of their inherent buoyancy maintain the doll or toy on the surface.

The present invention recognizes the value, of a doll and flotation device which are preferably made for easy combination and securement and of the pieces to one another as well as easy separation for effective teaching of the use of flotation devices as water safety devices. In order to do so it provides a toy doll which is heavier than the water so that it will readily sink to the bottom of a pool without the flotation device. Preferably the doll is provided with a miniature flotation device which is of a generally familiar and recognizable type, such as a life vest. There are many variations of flotation devices commonly used for boating which may be substituted for the vest, and for practical reasons of a form which can be adapted to the scale of the doll and preferably fit the doll in some way to help hold it in place when secured by tying or strapping it on to the doll or, like the vest, wrapping around it so that, when using clips, ties or fasteners to hold the flotation in place, it will not easily come off of the doll. A flotation device should also be selected with sufficient buoyancy to support the combined weight of the doll and its own weight above the water. The closer it simulates the full scale device which would support a human subject the better the acceptance should be for its use. The closer the steps taken to put on and attach a known scale down flotation device, the better for teaching. While intended principally for demonstration, for example, of the safety and structure of the flotation device, the combination and its use can teach children and adults the use and availability of various types of life saving flotation devices. It may enhance discussions of the need and circumstance of life saving devices at anytime, but actual use on a body of water is far more effective. This is particularly so since a child can handle the doll as well as seeing others demonstrate and then be allowed to place the flotation device on the doll and secure it in place by suitable fasteners. In demonstration the doll with the safety device secured, when it is dropped into water, all viewers can clearly see that the doll is supported above the water surface without any problem. However, when doll retrieved and the flotation device is removed and again dropped into water, the doll will no longer float, but will drop to the bottom of the pool. To emphasize its importance the flotation device separated from the doll may be left on the top of the water just to demonstrate and reinforce the viewer's memory of buoyancy. After such demonstration children will certainly enjoy playing lifeguard and diving for the doll who had neglected to wear his flotation device. Perhaps water safety can use such occasions to teach something about first-aid and resuscitation treatment as well.

For a better understanding of the present invention reference is made to the accompanying drawings in which FIG. 1 is a front elevational view of a doll in wearing a flotation device which by fastening means in accordance with the present invention.

Figures 4, 5:
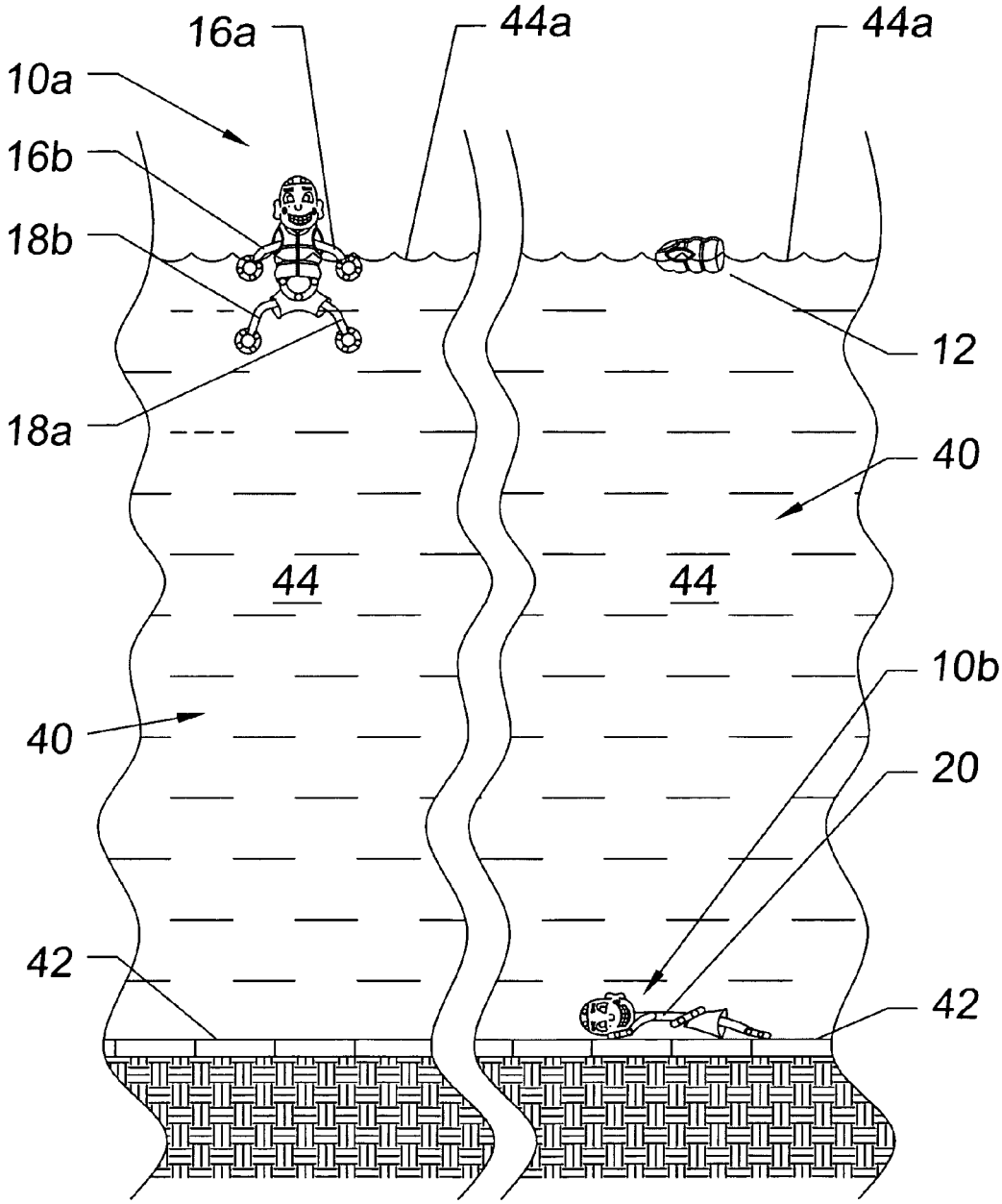

FIG. 4 shows a vertical section of a narrow slice of a swimming pool in which a doll wearing its flotation device floats at the surface of the water; and FIG. 5 is a similar view of portion of a pool showing a doll of the present invention with its flotation device removed from the doll and floating on top of the water while the doll is lying under water on the bottom of the pool and the unused flotation device at the surface is left at the surface.

Figure 1:
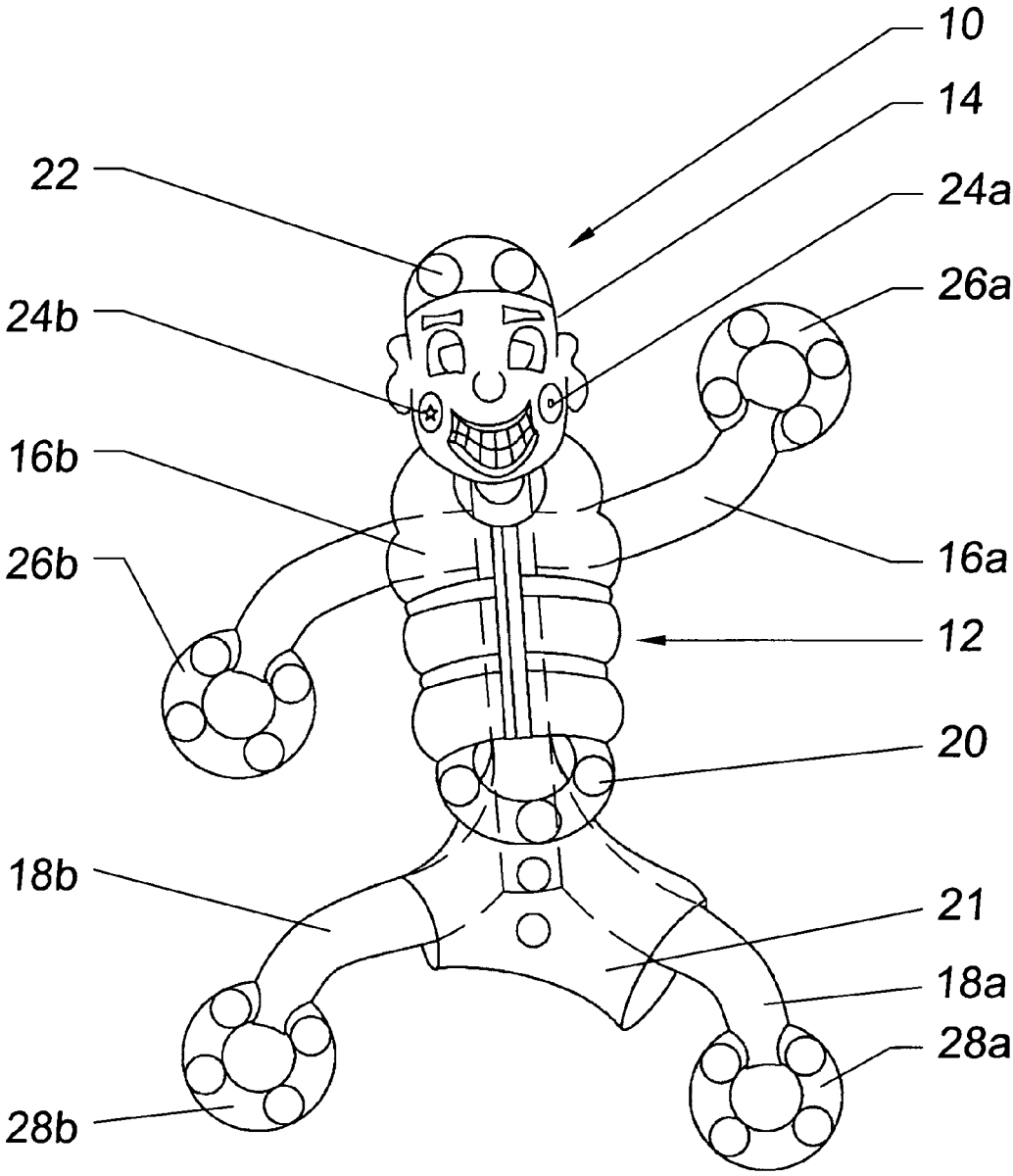

In FIG. 1 a doll, generally designated 10, in accordance with the present invention is wearing his flotation device in the form of a life vest generally designated 12. The doll 10 can assume a great variety of forms, of course, but in general, it must have some structure to represent major human body parts, realistically positioned relative to one another and reasonably proportionate to the size of the doll. The doll preferably has at least a head 14, a pair of arms 16*a* and 16*b* and a pair of legs 18*a* and 18*b*. Flexible arms and legs are preferably made of flexible water proof material, in turn, attached structure to represent a body 20. In this instance the "body" is covered by the life jacket 12 and bathing trunks 21. The trunks may be permanently secured to the body 20 or made removable if desired. The body 20 here is represented in a minimal form by a simple tubular or solid straight rigid or perhaps somewhat flexible piece either simply having square corners or rounded, solid or hollow in cross section. Such flexibility in choice of form recognizes the functional purpose and environment of use of the doll. The body could be shaped more like a human body in proportional size and shape. One end of each flexible arm 16*a* and 16*b* and each flexible leg 18*a* and 18*b* must be attached to the body 20 in appropriate position to realistically represent limbs of generally appropriate size and shape. While the body 20 may be made of rigid material, both the arms and legs need to be flexible to aid in putting the flotation device in place. Flexibility preferably is such that the arms and legs are not self-supporting but will droop or hang loosely from the body 20 and move around when held in the air or thrown into a pool as shown in FIG. 4. Since the doll is a toy, as shown here, it may be made to have a fanciful appearance. In the embodiment of FIG. 1, for example, it is provided with a clown head, perhaps molded of resinous material to a shape including most notably ears and eye sockets and possibly a nose. Whatever other shaping and detail is deemed appropriate may be included in any form desired by the designer. The head may be embellished by painting or other decoration. Design features such as a swimming hat 22 may be separable from the doll by being sized or shaped and made of material to make good frictional fit to the head to stay in place. A more practical approach, however, may be to paint a hat or hair on the head. Coloring of parts by painting may be preferred. Similarly fanciful designs 24*a* and 24*b* may be permanently applied by paint, or otherwise applied as part of the decorating process in completing the head. The doll, of course, need not be a clown, but have other human, animal or animated cartoon type features, as is deemed appropriate in various situations. The head, if made of plastic material, may be molded to the body structure 20. The body at its top may be narrowed to a neck portion. The arms 16*a* and 16*b* substitute as shoulders to support a life vest at the arm holes. Particularly when the head employs a fanciful design, the body structure may perhaps be acceptable, and even appealing to the imagination even when left very simple and without shape of a molded or shaped natural material which may be selected for its heavy weight or have weights added to cause the figure to sink. The arms and legs can be made solid or tubular and stuffed with material which can withstand constant use in water. No joints are required in any limbs and more flexibility allows movement to permit cooperation with a life vest. Instead of hands and feet, in the embodiment shown, the arms and legs are terminated in rings which may be said to simulate life saving rings 26*a* and 26*b*, for hands, and 28*a* and 28*b*, for feet, as desired.

Figure 2:
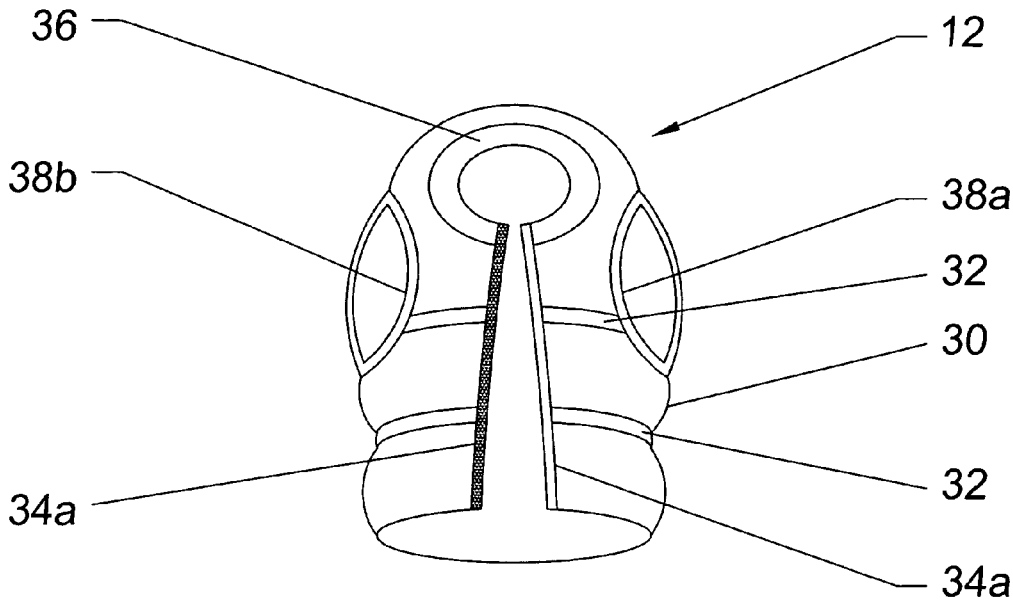
FIG. 2 is a front elevational view of a flotation device in the form of a life vest, which is shown open to receive the doll.
Figure 3:
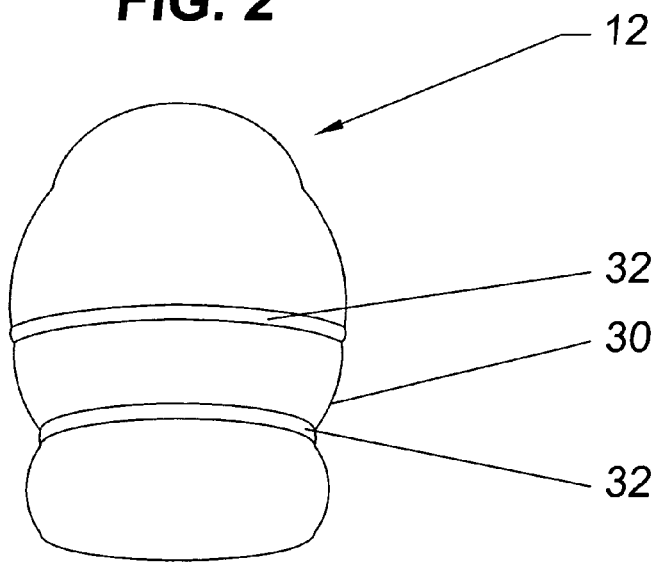
FIG. 3 is a back view of the life vest of FIG. 2.

Referring now to the flotation device shown in FIGS. 2 and 3, the device shown is intended to be a stylized life jacket of the type to be worn over the shoulders and around the body. The jacket, for example, may be made of a suitable fabric 31, such as the orange canvas cover material used for life jackets aboard ships. The cover may be formed by being generally doubled into a shell having casing of double wall with the fold at the bottom. In some cases it may be considered fun to use of an air inflatable jacket which, of course, will require a blow up valve. In most instances in the toy market for children the orange fabric might better be the enclosure for flotation material such as an appropriate water resistant, molded resinous foam or material such as foam rubber, for example. The fabric may be doubled back on itself to form the recess required and the edges stitched and possibly glued together to encase the flotation material. The jacket may have stitched straps 32 surrounding the jacket in which case stitching through the double layer forms pockets to help to hold the foam or other flotation material in place. The opposed edges may also be closed either by a folded overlay strip of the jacket material, or doubling of the layers or by a separate strap or straps sewn in place. Covering the hem or edging may be closure strips 34*a* and 34*b* are hook and loop opposed strips, such as Velcro®, that will self-engage as fasteners to hold the jacket closed as seen in FIG. 1 and in place on the doll. Many other types of clips, buttons or specifically protected fasteners may be substituted for Velcro®. The top of the jacket is cut and shaped to receive a collar 36 which is also sewn into position to complete the jacket. The collar may be used to close the sidewalls together and at the top aids in shaping the top to be suitable closure around the neck of the doll. In order to permit the arms to pass through arm holes 38*a* and 38*b*, the arm holes, like the neck hole 36, and other edge closing, may have the double layers enclosed and sewn over in a hem of folded material of the same type used in the jacket cover itself or each double edge may termatively be covered with a piece of the jacket material over the edge and sewn in place.

Referring now to FIG. 4, representing a partial vertical section of a swimming pool, generally designated 40, representing a vertical sectional view of only a small portion of a much larger complete swimming pool, is represented by fragmented breakaway from the larger pool structure by its jagged lines its side edges view beyond which the pool continues for its full size. The bottom of the pool 42 is represented as made of tile covered concrete. The sides, not shown, will be possibly also made of concrete or a similar material, covered by tiles. Water 44 fills the pool to a surface 44*a* on which is shown a floating doll, generally designated 10*a* which represent the floating combination of the invention. Referring next to FIG. 5, a similar partial sectional view of the same or a similar pool. However, the life vest 12*b* has been removed so that on the bottom of the pool 42 is a submerged doll, generally designated 10*b*. The removed jacket 12*b* of that doll is floating on the surface 44*a* of the water 44.

It is desirable to have a realistic type of positioning of the body when supported by a flotation device in FIG. 4. This requires placing of weight below the life vest to rotate the doll into the vertical position shown. In this case, such weighting may be supplied by a ring 17 of heavy metal or other relatively heavy material attached to the body 20 below the life vest. Weighting may be achieved in other ways including designing the doll to concentrate the weight of the doll below the jacket such that the center of gravity is below the flotation device when in place. In FIG. 5 the doll 10*b* is usually supported the doll on the bottom of the pool in a flat laid out position, unless on the bottom, it rolled over as it reached the bottom of the pool in sinking.

Returning to FIG. 1 it will be seen that the body may be characterized as a backbone which may be solid piece of heavy material. It may include suitable weighting material which will cause the doll and life vest combination to position correctly as shown in FIG. 4 when floating. Without the life jacket its weight will cause the doll to sink. Using a resinous material for the body may permit the body to be cast integrally, or the head and neck cast separately with a flexible connection between them to permit the head when floating, for example, to bob, if that is desired. The arms 16*a* and 16*b* can be made in a continuous piece and then secured across the back of the body, or each arm may be separately secured by some kind of fastener, or a means of securing it in a slot or otherwise suitable recess. The means of construction of the doll, like its form and appearance is not material to the invention. The same type of one piece construction of the legs is possible except that the legs 18*a* and 18*b*, as shown in the embodiment of FIG. 1 are spread more than natural and form a wider spread inverted "v". The legs nevertheless can likewise be made in a single piece. In other structures it may be preferred for each of the legs to be attached individually. The arms can also be attached separately. The arms and legs need not be highly articulate and are preferably loose and floppy so that they will tend to droop downwardly or move up when in the water when on the surface as shown in FIG. 4 or move when falling through the water to the pool bottom. Such construction also helps in getting the arms through arm holes in the life vest when putting it on the doll. It may be desirable to have the bathing trunks 21 permanently attached to the body 20 and arranged to cover the junctions of the legs and body but other constructions may permit the removal of the trunks and their replacement as desired.

It will be understood that the actual appearance of the individual doll is not the essence of the invention. Rather it is the concept of combining a doll with a flotation device which can be fixed onto and removed from the doll by a child and which will demonstrate that, when the vest is not on, a swimmer, like the doll, may end up the bottom of the pool. It further gives the possibility that a child who knows how to make shallow dives may recover the doll in a simulated rescue. The child can then place the flotation device on the doll, perhaps after simulating some sort of rescue and resuscitation process.

The dolls may have much more refined construction and may look more human or even less human, as fictional animal characters, for example. A bear, or any other type of animal character, real or fictitious, might be an appropriate choice. The materials used in the doll must be such that it will resist destruction by being in or around the water and in view of undoubted rough handling by children throwing and playing with it actively. However if their play represents a positive learning experience and appreciation of the value of life-saving flotation devices, the purpose of the invention will have been achieved.

I claim:

1. A combination doll and flotation device for demonstrating water safety, comprising:

a doll representing a human-like form sufficiently heavy to sink in water to the bottom and remain submerged, and a removable flotation device of a size and shape to fit the doll in a predetermined fashion, composed of material which will float and support its own weight, and of a size and design to support the weight of the doll as well, on the surface of the water, and connection means on the flotation device to permit easy connection and release to hold the flotation device onto the doll and when released from one another to allow separation of the doll from the flotation device such that the doll may sink into the water.

2. The combination of claim 1 in which the flotation device is a life jacket and the doll has flexible arms allowing the arms to pass through the arm holes of the life jacket when putting the life jacket in place on the doll.

3. The combination of claim 2 in which the easy connection and release connection means on the jacket are Velcro® attached to opposed edges which close the front of the jacket.

4. The combination of claim 1 in which the doll simulates a human figure but has flexible arms and legs which may move in water and which permit the flotation device or other simulated clothing to be easily put in place.

5. The doll of claim 4 in which the body is simply a connector piece to which a head, two arms and two legs are attached and no attempt is made for the connector to simulate a human body torso.

* * * * *